US012409973B2

(12) United States Patent
Glaser et al.

(10) Patent No.: US 12,409,973 B2
(45) Date of Patent: Sep. 9, 2025

(54) PALLET FOR TRANSPORT OF DRUMS

(71) Applicant: MOMENTIVE PERFORMANCE MATERIALS GMBH, Leverkusen (DE)

(72) Inventors: John Glaser, Halfmoon, NY (US); Matthias Reimann, Dormagen (DE); Christian Schmolke, Wermelskirchen (DE)

(73) Assignee: Momentive Performance Materials GmbH, Leverkusen (DE)

( * ) Notice: Subject to any disclaimer, the term of this patent is extended or adjusted under 35 U.S.C. 154(b) by 163 days.

(21) Appl. No.: 18/009,411

(22) PCT Filed: Jun. 10, 2021

(86) PCT No.: PCT/EP2021/065611
§ 371 (c)(1),
(2) Date: Dec. 9, 2022

(87) PCT Pub. No.: WO2021/250166
PCT Pub. Date: Dec. 16, 2021

(65) Prior Publication Data

US 2023/0312169 A1 Oct. 5, 2023

Related U.S. Application Data

(60) Provisional application No. 63/037,148, filed on Jun. 10, 2020.

(30) Foreign Application Priority Data

Oct. 13, 2020 (EP) ..... 20201544

(51) Int. Cl.
*B65D 19/00* (2006.01)
*B65D 19/38* (2006.01)
*B65D 19/44* (2006.01)

(52) U.S. Cl.
CPC ..... *B65D 19/0026* (2013.01); *B65D 19/38* (2013.01); *B65D 19/44* (2013.01);
(Continued)

(58) Field of Classification Search
CPC ..... B65D 19/38; B65D 19/44; B65D 2519/00815; B65D 2519/00034;
(Continued)

(56) References Cited

U.S. PATENT DOCUMENTS 2,444,326 A * 6/1948 Baker ..... B65D 19/0026 108/55.3
3,628,468 A * 12/1971 Angelbeck, Jr. ... B65D 19/0014 108/55.3
(Continued)

FOREIGN PATENT DOCUMENTS

CA 2974609 A1 1/2019
CN 110589173 A 12/2019
(Continued)

OTHER PUBLICATIONS

English translation of EP 251961 from espacenet (Year: 2024).*
(Continued)

*Primary Examiner* — Daniel J Rohrhoff
(74) *Attorney, Agent, or Firm* — Dilworth & Barrese, LLP

(57) ABSTRACT

The patent application concerns a drum pallet (10) suitable for positioning one drum or a plurality of drums thereon, wherein the pallet has a deck (11), skids (2) and a plurality of blocks (12), coupling the deck with the skids, thereby forming a gap (5) therebetween for receiving a lifting member. The deck and the plurality of blocks form one monolithic body (1). The skids are connected below the blocks to the blocks. The body consists of a compression molded thermoset composite. The upper surface (13) of the
(Continued)

deck comprises vertical protrusions (14A, 14B) adapted to avoid shifting of the drum along the surface, if the drum is positioned on the deck and aligned with the protrusions.

19 Claims, 3 Drawing Sheets

(52) U.S. Cl.
CPC ..... *B65D 2519/00034* (2013.01); *B65D 2519/00039* (2013.01); *B65D 2519/00069* (2013.01); *B65D 2519/00129* (2013.01); *B65D 2519/00273* (2013.01); *B65D 2519/00288* (2013.01); *B65D 2519/00323* (2013.01); *B65D 2519/00333* (2013.01); *B65D 2519/00407* (2013.01); *B65D 2519/00437* (2013.01); *B65D 2519/00786* (2013.01); *B65D 2519/00815* (2013.01)

(58) Field of Classification Search
CPC ..... B65D 2519/00039; B65D 2519/00273; B65D 2519/00288; B65D 2519/00437
See application file for complete search history.

(56) References Cited

U.S. PATENT DOCUMENTS

| | | | | | |
|---|---|---|---|---|---|
| 3,834,323 | A * | 9/1974 | Weinmann | B65D 19/44 | 108/57.13 |
| 3,995,749 | A * | 12/1976 | Haskins | B65D 19/44 | 206/821 |
| 4,516,677 | A * | 5/1985 | Rowland | B65D 71/70 | 108/55.3 |
| 5,092,464 | A * | 3/1992 | Taylor | B65D 85/66 | 206/415 |
| 5,809,904 | A * | 9/1998 | Darby | B65D 19/44 | 108/53.5 |
| 6,484,877 | B1 * | 11/2002 | Murakami | B65D 85/06 | 108/55.3 |
| 10,589,897 | B1 | 3/2020 | Shawaf et al. | | |
| 2006/0124478 | A1 * | 6/2006 | Marcao | B65D 85/06 | 206/304 |
| 2013/0206043 | A1 * | 8/2013 | Baltz | B65D 19/0038 | 108/51.11 |
| 2016/0251114 | A1 * | 9/2016 | Lee | B65D 85/06 | 108/55.3 |
| 2017/0190467 | A1 * | 7/2017 | Clark | B65D 19/04 | |
| 2017/0225827 | A1 * | 8/2017 | Ikeguchi | B65D 19/44 | |
| 2018/0290789 | A1 * | 10/2018 | Jain | B65D 19/44 | |
| 2019/0177038 | A1 * | 6/2019 | Veldhuis | B65D 85/62 | |
| 2020/0172289 | A1 * | 6/2020 | Swartz | B65D 19/0002 | |

FOREIGN PATENT DOCUMENTS

| | | | | | |
|---|---|---|---|---|---|
| CN | 113291579 | A * | 8/2021 | | |
| CN | 110589173 | B * | 9/2021 | B65D 19/18 | |
| DE | 202 10 721 | U1 | 10/2002 | | |
| DE | 20 2012 101784 | U1 | 6/2012 | | |
| DE | 102011054682 | A1 * | 4/2013 | B65D 19/0038 | |
| DE | 102012019712 | A1 | 4/2014 | | |
| EP | 251961 | A * | 1/1988 | B65D 19/44 | |
| EP | 1382534 | A2 | 1/2004 | | |
| EP | 2716565 | A1 | 4/2014 | | |
| GB | 2013615 | A * | 8/1979 | B65D 19/44 | |
| JP | S4861550 | U | 11/1971 | | |
| JP | 2000318735 | A | 11/2000 | | |
| JP | 2001130571 | A * | 5/2001 | | |
| JP | 2004268942 | A | 9/2004 | | |
| JP | 2005510422 | A | 4/2005 | | |
| JP | 2010001053 | A | 1/2010 | | |
| JP | 2010228800 | A | 10/2010 | | |
| JP | 2020001725 | A | 1/2020 | | |
| WO | 2011/073496 | A1 | 6/2011 | | |

OTHER PUBLICATIONS

First Office Action from corresponding Chinese application No. 202180059754.2, dated Sep. 30, 2024.
1st Office Action from corresponding Japanese Application No. 2022-575,968 dated Apr. 15, 2025.

* cited by examiner

PALLET FOR TRANSPORT OF DRUMS

BACKGROUND OF THE INVENTION

Pallets on the market are designed to be loaded with thereon secured goods and are commonly used for truck transport. For optimal use of space in truck transport or the like, pallets are modular in a fixed grid dimension, like e.g. 600×600 mm, 600×900 mm, 600×1200 mm, 800×1200 mm (EURO pallet) or 1200×1200 mm.

The majority of the pallets on the market have a smooth deck on their upper surface and intended for regular transport of any goods, not specifically for drums. Other pallets have an upper deck consisting of a plurality of wooden slats, extending parallel with gaps in between. The decks of the slats are all in the same layer and carry the goods.

These smooth decks have the drawback that goods may shift on the decks during transport and therefore need much effort to execute an efficient transport safety and load securing for transport.

Pallets are either made of wood, plastic or mixed materials. Multi component pallets are unstable and/or unresistant against high mechanical stress. The durability of such pallets is very limited. Very critical is the fact that serious damages of such pallets are not always visible and could cause serious damages to the drum and its content. Depending on the content of the drum, hidden damages could lead to EHS-incidents as well as accidents.

A pallet on the market of Ahrma Holding B.V., The Netherlands, is designed for the specific use of drums and is made of multi components. The pallet consists of a wooden body which is partially coated and glued with PU parts. If for any reason a part of the pallet gets lost or breaks off, often fine wooden particles are set free. This has to be strictly avoided in any highly sensitive production area, like in the pharmaceutical industry.

The above mentioned applies similarly to any "Explosion Proof Production Area" (or ExProof Area). Therefore, the mentioned pallet is not suitable for use in any ExProof Area.

SUMMARY OF THE INVENTION

In accordance with the present invention, there is provided a new and improved drum pallet suitable for positioning one drum or a plurality of drums thereon, wherein

- the pallet has a deck, a skid and a plurality of blocks, between coupling the deck with the skids, thereby forming a gap therebetween for receiving a lifting member;
- the deck and the plurality of blocks form one monolithic body;
- the skids are connected below the blocks to the blocks;
- the body consists of a compression molded thermoset composite.

The drums are cylindrical containers for liquids or chemicals. They are mostly composed of metal or plastic, preferably metal.

The process of manufacturing such pallet is the compression moulding, what generates a very stable and durable product. Compression Moulding is a method of moulding in which the moulding material, generally preheated, is first placed in an open, heated mould cavity. The mould is closed with a top force or plug member, pressure is applied to force the material into contact with all mould areas, while heat and pressure are maintained until the moulding material has cured. The process employs thermosetting resins in a partially cured stage, either in the form of granules, putty-like masses, or preforms. Compression molding is a high-volume, high-pressure method suitable for molding complex, high-strength fiberglass reinforcements. Also, it is one of the lowest cost molding methods compared with other methods such as transfer molding and injection molding; moreover it wastes relatively little material, giving it an advantage when working with expensive compounds. With its ability to create complex parts with a huge variety of applications while keeping part cost and turnaround time a priority, compression molding is an advantageous process for manufacturers the pallet for drums.

If the deck and the plurality of blocks form one monolithic body, the mounting of a pallet needs less working steps. An accidental removal of a block becomes less likely.

Preferably, the skids consist of a compression molded thermoset composite.

Thus, the skids and the body might be manufactured in one single mold and by one single pressing act.

Preferably the compression molded thermoset composite is a Low Density Polyethylene (LDPE)-recycling material.

Preferably the compression molded thermoset composite does not contain any wood particles.

Therefore, no wooden particles may be set free if parts of the pallet break. This allows safe us of the pallet in any highly sensitive production area, like in the pharmaceutical industry or "Explosion Proof Production Area".

Preferably, the skids are screwed or welded below the blocks.

Preferably, the upper surface of the deck comprises vertical protrusions adapted to avoid shifting of a drum along the surface, which is positioned on the deck and aligned with the protrusions.

This results a perfect nestable fitting of the drum or drums on the pallet. The necessary measurements in case of transport safety and load securing are reduced. The pallet, in particular as described below, fulfills the aspects of "Load Securing" according to DIN/EN 12642.

Preferably, the protrusions are designed so that two drums with a similar certain diameter might be positioned on the deck in juxtaposition with each other. Thereby the protrusions are designed so that as an alternative only one single drum with the same certain diameter might be positioned on the deck and aligned with the protrusions thereby avoiding shifting of the drum or the drums. Thereby, the position of the one single drum is aligned in the middle of the positions designated for the two drums.

Therefore, this single pallet might be used for positioning, handling and transporting of one or two drums, being hold in a perfect nestable fitting on the pallet. The next pallet can be positioned on top of the exactly aligned and centered single drum or the two drums of the pallet below. It is important that the two positions for the two drums are in juxtaposition with each other, so that the position in between for the single drum has to be overlapping with the two positions of the two drums. So, a pallet designed to carry not more than two drums in juxtaposition with each other, might also be loaded with only one single drum and still is perfectly nestable. Therefore, in one embodiment, the pallet has a rectangular base and not a square base and a size that allows that no more than two drums might be positioned on the deck in juxtaposition with each other and aligned with the protrusions thereby avoiding shifting.

The similar concept is claimed for a pallet for three or four drums being positioned side-by-side in a shape of a triangle (tree drums) or a square (four drums): These drums might also be loaded with one single drum positioned in the center of the triangle or square.

Preferably the pallet is designed so, that the drum might be a metal or plastic drum, in particular with a volume of 220 liters and/or a diameter of 572 mm. Generally, the pallet might be designed so, that the drum might be a metal or plastic drum, in particular with a volume of 20 to 250 liters Preferably the protrusions are designed so, that the drum might be a metal or plastic drum, with a convex shaped bottom of the drum with a rim on which the drum may stand, whereby the securings against shifting is provided by the interaction between the rim of the convex shaped bottom of the drum and the protrusions on the surface of the deck.

Preferably, the protrusions are formed by a plateau layer on the surface of the deck and have combinations of concave and convex edges fitting to the shape of the rim of the drum on which the drum may stand.

Preferably, the protrusions on the deck and the plurality of blocks form one monolithic body.

Thereby, the protrusions which might be formed by a plateau on the surface, can be formed in one single step during the compression molding. Any accidental removal of a protrusion or plateau layer becomes less likely.

Preferably, the body comprises reinforcement elements, like metal profiles, extending in the deck and connecting the blocks.

These elements might be added after compression molding or preferably, might be inserted into the mold before the step of compression molding resulting in a strong bond between the elements and the body. If the reinforcement element is inserted into the mold before molding, the manufacture is easy to preform, gives a strong bond and protects the reinforcement element against environmental influences, like acids, if the element is totally covered by the body.

Preferably, the reinforcement elements, e.g. metal profiles, are shaped as T-Profiles, extend along the four sidewalls connecting the blocks.

Based on the design of the production tool the pallet can be equipped additionally by metal profiles in longitudinal or transverse direction to reinforce the level of stability. For instance, such stability is necessary if the good will be long stored in high rack warehouses w/o intermediate floors.

Preferably, the reinforcement elements can be designed suitable for increasing of load capacity above 2000 kg. In order to reinforce the stability of the pallet, the reinforcement elements can be implemented each on the sides of the length and width thereby connecting the blocks. Any standard grid or dimension of a pellet might apply, for example the pallet dimension might be 600×600 mm, 600×900 mm, 600×1200 mm, 800×1200 mm (EURO pallet) or 1200×1200 mm, suitable to place 4 or 3 instead of 2 drums. For example, in case of 0.6 m×1.2 m pallet, the element might be implemented on the sides with the length of 0.6 m and on the sides with the length of 1.2 m, Preferably, the lower side of the deck and/or the blocks might comprise a technical web reinforcing the structure at low weight. The web is part of the body and can be form molded in one step with the rest of the body. The web might also be part of the blocks.

Preferably, the pallet has the dimension 0.6 m×1.2 m for optimal use of space in truck transport or the like. However, any standard grid or dimension of a pellet might apply, for example the pallet dimension might be 800×1200 mm (EURO pallet) or 1200×1200 mm, suitable to place 4 or 3 instead of 2 drums.

BRIEF DESCRIPTION OF THE DRAWINGS

The features and advantages of the invention will be appreciated upon reference to the following drawings of a number of exemplary embodiments, in which.

DETAILED DESCRIPTION OF THE PREFERRED EMBODIMENT

Figure 1:
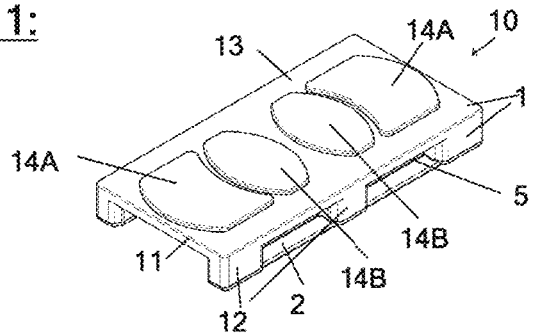
FIG. 1 shows a perspective view of a pallet according to the invention.

FIG. 1 shows a perspective view of a pallet according to the invention. the drum pallet 10 suitable for positioning one drum or two drums thereon hat the dimension 1200 mm×600 mm. The pallet 10 has a deck 11, two skids 2 and a plurality of blocks 12, which couple the deck 11 with the skids 2, thereby forming a gap 5 therebetween for receiving a lifting member, not being shown. The deck 11 and the plurality of blocks 12 form one single monolithic body 1.

The skids 2 are connected below the blocks 12 to the blocks by screws, not being shown.

The body 1 consists of a compression molded thermoset composite, here a Low Density Polyethylene (LDPE)—recycling material not containing any wood particles.

The upper surface 13 of the deck 11 comprises vertical protrusions 14A, 14B adapted to avoid shifting of a drum along the surface. Here, the pallet and the protrusions are designed so, that the drum might be a metal drum, in particular with a volume of 220 liters and/or a diameter of 572 mm. the drum with a convex shaped bottom of the drum with a rim on which the drum may stand, allows a fit between the rim of the convex shaped bottom of the drum and the protrusions on the surface of the deck.

The protrusions 14A, 14B are formed by a plateau layer on the surface 13 of the deck, whereby the protrusions on the deck and the plurality of blocks form one monolithic body. Two adjacent different protrusions 14A, 14B together fit into the rim of a drum, thereby securing it against shifting on the surface. Thereby, the first protrusion 14A of the two adjacent different protrusions 14A, 14B, has one convex edge and one concave edge. The second protrusion 14B of the two adjacent different protrusions 14A, 14B, has two concave edges. Thereby, it is possible to secure two adjacent drums onto the pallet 10.

If only one drum is to be secured in the middle of the pallet, it is still possible to stack a further pallet onto said pallet. Therefore, two adjacent similar protrusions 14B, 14B together fit into the rim of a drum, thereby securing it against shifting on the surface. Both protrusions 14B 146 have two concave edges. Thereby, it is possible to secure one single drum onto the pallet 10 in the middle of the pallet.

Figure 2:
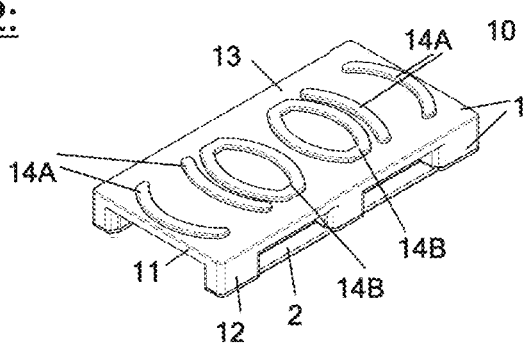
FIG. 2 shows a perspective view of a pallet with a different plateau according to the invention.

FIG. 2 shows a perspective view of a pallet with different protrusions according to the invention. The protrusions 14A, 14B have the same convex and concave edges as the plateaus of embodiment of FIG. 1, but do not form plateaus.

Figure 3:
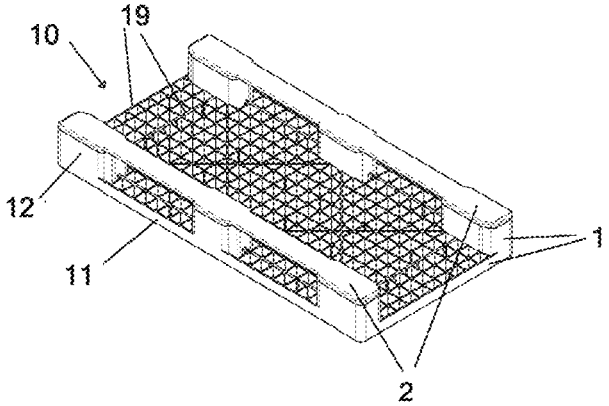
FIG. 3 shows a perspective view of the pallet from below showing the technical web.

FIG. 3 shows a perspective view of the pallet from below showing a technical web 19 consisting of ribs and reinforcing the structure at low weight. The technical web 19 is below the deck 11, is part of the body 1 and can be form molded in one step with the rest of the body.

Figure 4:
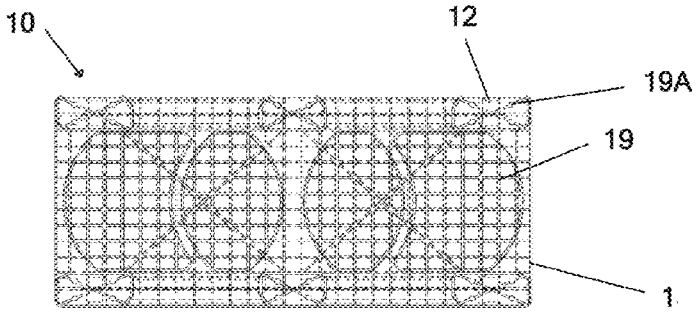
FIG. 4 shows a bottom view of the pallet of FIG. 3.

FIG. 4 shows a bottom view of the pallet of FIG. 3 and illustrates that the web 19A might also be part of the blocks 12, resulting in reduced material and weight of the blocks.

Figure 5A:
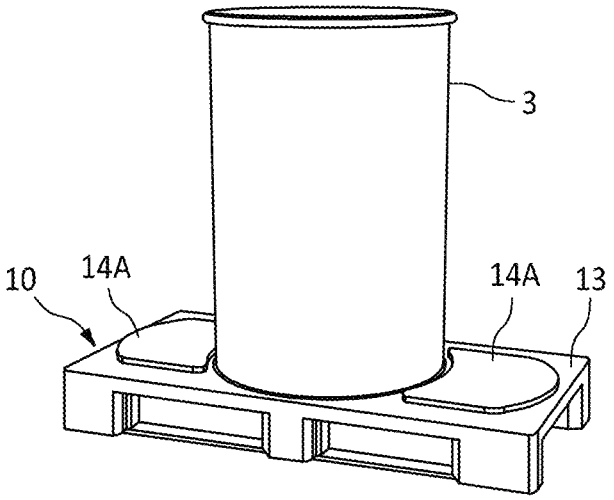
FIG. 5A shows a perspective view of a pallet according to the invention loaded with one single drum.

FIG. 5A shows a perspective view of a pallet 10 according to the invention loaded with one single drum 3 in the middle of the surface 13 of the deck.

Figure 5B:
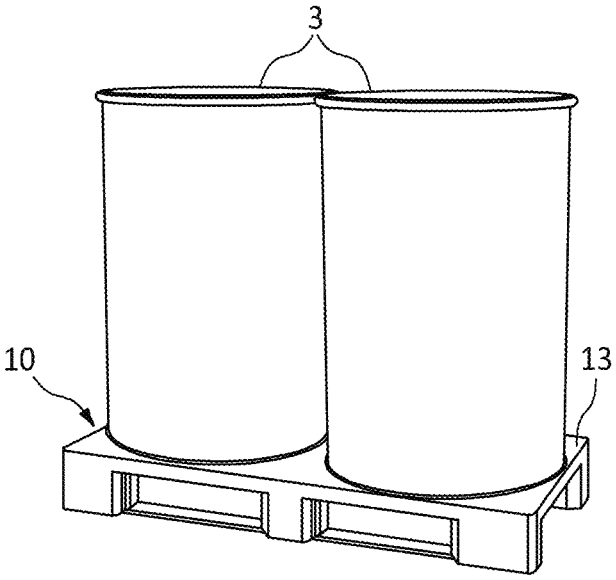
FIG. 5B shows a perspective view of the pallet of FIG. 5A loaded with two drums.
Figure 6:
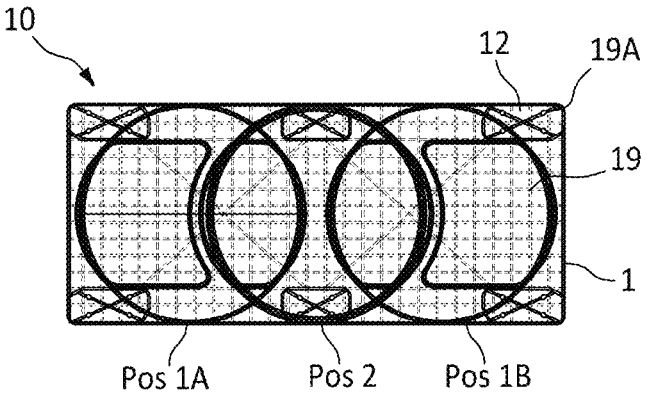
FIG. 6 shows a bottom view of the pallet of FIG. 3.

FIG. 5B shows a perspective view of the same pallet of FIG. 5A, which here is loaded with two drums 3.

FIG. 4 shows a bottom view of the pallet of FIG. 3 and illustrates how the protrusions define the positions POS 1A and POS 1B for two drums with a similar certain diameter in juxtaposition with each. Alternatively, only one single drum with the same certain diameter might be positioned on the deck and aligned with the protrusions thereby avoiding shifting of the drum or the drums, whereby the position Pos 2 of the one single drum is aligned in the middle of the positions designated for the two drums.

Figure 7:
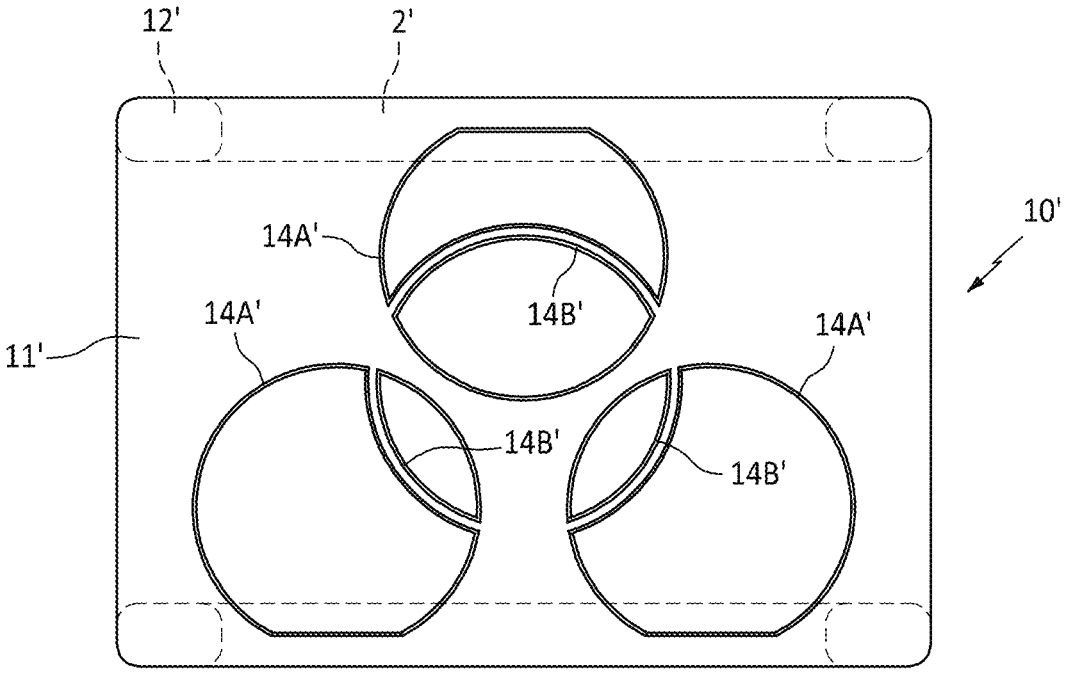
FIG. 7 shows a top plan view of a pallet according to another embodiment of the invention for securing up to three pallets.

FIG. 7 shows a top plan view of a three-drum pallet 10' according to the invention. Three-drum pallet 10' is suitable for positioning one drum or no more than three drums of a certain diameter thereon. Three-drum pallet 10' has a deck with an upper surface 13', two skids 2' and a plurality of blocks 12'. Upper surface 13' comprises vertical protrusions 14A' and 14B' adapted to engage with a bottom rim of a drum and avoid shifting of the drum along upper surface 13'. Protrusions 14A' are arranged so that three drums with a similar certain diameter can be positioned in a shape of a triangle on upper deck surface 13' in juxtaposition with each other. Protrusions 14B' are arranged so that one single drum with the certain diameter can be positioned on the deck and aligned with, whereby the position of the one single drum is aligned in the center of the positions designed for the three drums. Protrusions 14B' will engage a single centrally located drum and protrusions 14A' will engage three drums in the arrangement of a triangle.

Figure 8:
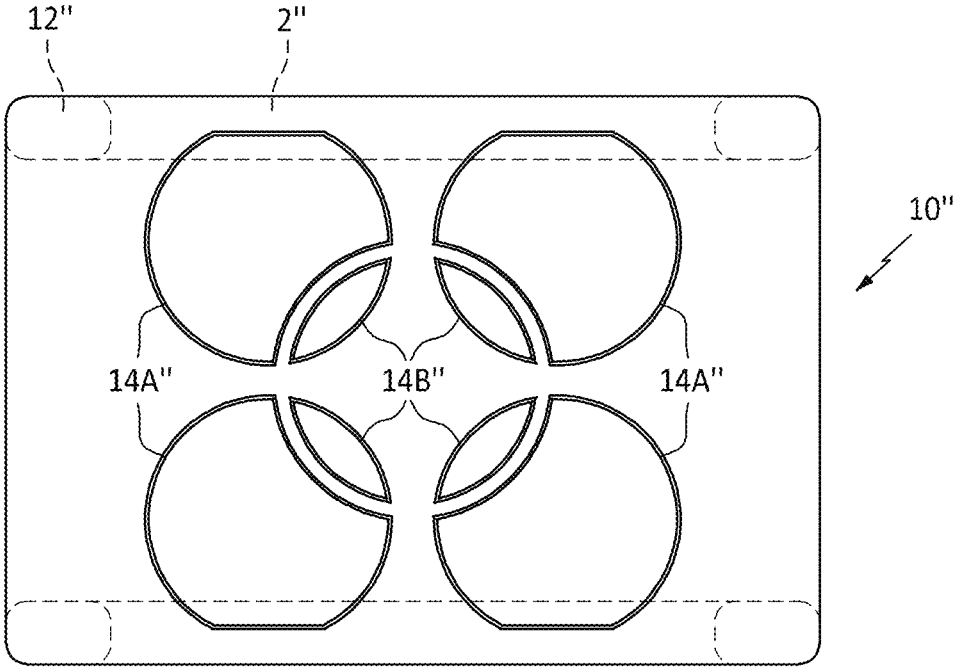
FIG. 8 shows a top plan view of a pallet according to another embodiment of the invention for securing up to four pallets.

FIG. 8 shows a top plan view of a four-drum pallet 10" according to the invention. Four-drum pallet 10" is suitable for positioning one drum or no more than four drums of a certain diameter thereon. Four-drum pallet 10" has a deck with an upper surface 13", two skids 2" and a plurality of blocks 12". Upper surface 13" comprises vertical protrusions 14A" and 14B" adapted to engage with a bottom rim of a drum and avoid shifting of the drum along upper surface13". Protrusions 14B" will engage a single centrally located drum. Protrusions 14A" will engage with four drums of a similar certain diameter positioned in a shape of a square on upper surface 13" side-by-side in the arrangement of a square.

What is claimed:

1. A drum pallet suitable for positioning one drum or a plurality of drums, each drum having a selected diameter and a convex rim on a lower periphery thereof, wherein the pallet has a deck having an upper surface, at least one skid and a plurality of blocks, coupling the deck with the at least one skids, thereby forming a gap therebetween for receiving a lifting member;

the deck and the plurality of blocks form one monolithic body;

the skids are connected below the blocks to the blocks;

the body is formed of a compression molded thermoset composite; and the upper surface of the deck comprise convex protrusions and concave recesses adapted to engage with the convex rim of the one drum or the more than one drum and to restrain the drum(s) from shifting position along the upper surface, when the one drum or the more than one drum is positioned on the deck and aligned with the protrusions and recesses;

wherein the protrusions and recesses are configured on the upper surface such that two or more drums with the selected diameter will engage with the protrusions and recesses in a position side-by-side on the deck and also, alternatively, one drum will engage with the protrusions and recesses at a position in a center location on the deck overlapping a position where the two or more drums are retained side-by-side, thereby avoiding shifting of the one drum or the more than one drum.

2. The drum pallet according to claim 1, wherein the pallet has a rectangular base and not a square base and a size that allows no more than two drums of the selected diameter to be positioned on the deck in juxtaposition with each other and aligned with the protrusions and recesses, thereby avoiding shifting.

3. The drum pallet according to claim 1, wherein the protrusions and recesses are designed such that four drums with the selected diameter can be positioned in a shape of a square on the deck side-by-side, and also, alternatively, one single drum with the selected diameter can be positioned on the deck and aligned with the protrusions and recesses, thereby avoiding shifting of the drum or the drums, whereby the position of the one single drum is aligned in the center of the positions designed for the four drums.

4. The drum pallet according to claim 1, wherein the pallet has a size that allows no more than four drums of the selected diameter to be positioned on the deck side-by-side and aligned with the protrusions and recesses, thereby avoiding shifting.

5. The drum pallet according to claim 1, wherein the protrusions and recesses are designed such that three drums with the selected diameter can be positioned in a shape of a triangle on the deck in juxtaposition with each other, and also, alternatively, one single drum with the selected diameter can be positioned on the deck and aligned with the protrusions and recesses, thereby avoiding shifting of the drum or the drums, whereby the position of the one single drum is aligned in the center of the positions designed for the three drums.

6. The drum pallet according to claim 1, wherein the pallet has a size that allows no more than three drums of the selected diameter to be positioned on the deck in juxtaposition with each other and aligned with the protrusions and recesses, thereby avoiding shifting.

7. The drum pallet according to claim 1, wherein the pallet is adapted such that the drum can be formed of plastic or metal, having a volume of 220 liters and/or a diameter of 572 mm.

8. The drum pallet according to claim 1, wherein the protrusions and recesses are adapted such that the drum can be formed of plastic or metal, whereby the securing against shifting is provided by the interaction between the convex rim of the drum and the protrusions and recesses on the surface of the deck.

9. The drum pallet according to claim 1, wherein the protrusions and recesses are formed by a plateau layer on the surface of the deck and have combinations of concave and convex edges fitting to a shape of the rim of the drums on which the drum will stand.

10. The drum pallet according to claim 1, wherein the protrusions and recesses on the deck and the plurality of blocks form one monolithic body.

11. The drum pallet according to claim 1, wherein the body comprises metal reinforcement elements extending in the deck and connecting the blocks, and the reinforcement elements are shaped as T-Profiles or extend along the four outer sidewalls of the pallet connecting the blocks.

12. The drum pallet according to claim 11, wherein the reinforcement elements are suitable for increasing of load capacity above 2000 kg.

13. The drum pallet according to claim 1, wherein the lower side of the deck and/or the blocks comprise a technical web reinforcing the structure.

14. The drum pallet according to claim 1, wherein the pallet has the dimension 0.6 m×1.2 m, and is designed for two drums.

15. The drum pallet according to claim 1, wherein the pallet has the dimension 1.2 m×1.2 m, and is designed for engaging three or four drums.

16. The drum pallet according to claim 1, wherein the skids are formed of a compression molded thermoset composite.

17. The drum pallet according to claim 16, wherein the compression molded thermoset composite is a Low Density Polyethylene (LDPE)—recycling material.

18. The drum pallet according to claim 16, wherein the compression molded thermoset composite does not contain any wood particles.

19. The drum pallet according to claim 1, wherein the skids are screwed or welded to the blocks below the blocks.

* * * * *